US005220099A

United States Patent [19]

Schreiner et al.

[11] Patent Number: 5,220,099

[45] Date of Patent: Jun. 15, 1993

[54] PURIFICATION OF A HYDROCARBON FEEDSTOCK USING A ZEOLITE ADSORBENT

[75] Inventors: James L. Schreiner, Seabrook; Robert A. Britton, Spring; Charles T. Dickson, Houston; Frederick A. Pehler, Jr., Humble, all of Tex.

[73] Assignee: Exxon Chemical Patents Inc., Linden, N.J.

[21] Appl. No.: 238,854

[22] Filed: Aug. 31, 1988

[51] Int. Cl.[5] ..... C07C 7/12; C10G 25/00

[52] U.S. Cl. ..... 585/820; 585/823; 585/824; 585/826; 585/827; 585/829; 585/831; 208/310 Z

[58] Field of Search ..... 585/823, 824, 826, 827; 208/310 Z

[56] References Cited

U.S. PATENT DOCUMENTS

| | | | |
|---|---|---|---|
| 2,881,862 | 4/1959 | Fleck et al. | 585/827 |
| 2,950,336 | 8/1960 | Kimberlin, Jr. et al. | 208/310 Z |
| 2,978,407 | 4/1961 | Tuttle et al. | 208/310 Z |
| 3,063,934 | 11/1962 | Epperly et al. | 208/91 |
| 3,182,014 | 5/1965 | Seelig et al. | 585/823 |
| 3,228,995 | 1/1966 | Epperly et al. | 585/823 |
| 3,278,422 | 10/1966 | Epperly et al. | 208/310 Z |
| 3,558,732 | 1/1971 | Nevzil | 208/310 Z |
| 4,313,014 | 1/1982 | Kondo et al. | 585/827 |
| 4,337,156 | 6/1982 | deRosset | 208/310 Z |
| 4,567,312 | 1/1986 | Miller et al. | 585/455 |
| 4,567,315 | 1/1986 | Owaysi et al. | 585/827 |
| 4,571,441 | 2/1986 | Miwa et al. | 570/211 |
| 4,795,545 | 1/1989 | Schmidt | 585/823 |

FOREIGN PATENT DOCUMENTS

| | | |
|---|---|---|
| 0164905 | 12/1985 | European Pat. Off. . |
| 2095861 | 2/1972 | France . |
| 1298202 | 3/1987 | U.S.S.R. . |
| 827433 | 2/1960 | United Kingdom . |

OTHER PUBLICATIONS

A copy of European Search Report—EP 89 30 8679 (Nov. 12, 1989).

*Primary Examiner*—Theodore Morris
*Assistant Examiner*—Walter D. Griffin
*Attorney, Agent, or Firm*—Linda K. Russell

[57] ABSTRACT

A process for purifying linear paraffins in which a hydrocarbon stream containing linear paraffins contaminated with aromatics, sulfur-, nitrogen-, and oxygen-containing compounds, and color bodies, but essentially free of olefins, is contacted with a zeolitic solid adsorbent such as a NaX zeolite or zeolite MgY. After adsorption the zeolitic solid adsorbent is desorbed with an alkyl-substituted aromatic desorbent such as toluene.

92 Claims, No Drawings

PURIFICATION OF A HYDROCARBON FEEDSTOCK USING A ZEOLITE ADSORBENT

BACKGROUND OF THE INVENTION

The present invention relates to a process for separating, purifying, and isolating paraffins. More specifically, the present invention is directed to a process for purifying linear paraffins, and especially kerosene range linear paraffins, by removing therefrom contaminants such as aromatic compounds, sulfur- and nitrogen-containing compounds, and oxygen-containing compounds such as phenolics.

DESCRIPTION OF BACKGROUND AND RELEVANT MATERIALS

As within any hydrocarbon product whose starting point is crude oil, the degree of purity to which paraffins may be refined covers a wide range from relatively crude to relatively pure. While each grade of paraffins has commercial use, there are special applications which require a paraffin product of exceptional purity. Certain of these special applications additionally require a paraffin product whose composition is substantially limited to linear paraffins, which may alternatively be referred to as normal, unbranched, or straight-chain paraffins.

One such special application is the manufacture of detergents, in which linear paraffins may serve as the alkyl constituent of sulfonated alkylaryl-and alkyl-sulfonate synthetic detergents. Linear paraffins are preferred in such manufacture because they result in a product having superior detergent properties, which moreover has superior biodegradability compared to synthetic detergents manufactured from branched paraffins.

Other important uses for substantially pure linear paraffins include as ingredients for the manufacture of flameproofing agents; as reaction diluents; as solvents; as intermediates in aromatization reactions; as plasticizers; and for use in preparation of protein/vitamin concentrates.

Unfortunately, substantially pure linear paraffins are extremely difficult to obtain. Linear paraffins intended for industrial and commercial usage are not produced by synthesis, but are instead isolated from naturally-occurring hydrocarbon sources, and most typically from the kerosene boiling range fraction of natural hydrocarbon feedstocks (as used herein, the term "kerosene range" refers to a boiling point range of between about 182°-277° C.). These feedstocks are made up of a wide variety of hydrocarbon constituents and include, in addition to paraffins, contaminants such as aromatic compounds, and heteroatom compounds such as sulfur-containing compounds, nitrogen-containing compounds, and oxygen-containing compounds (i.e., phenolics).

The commercial processes used for separating out the linear paraffin component of such feedstocks are generally not sufficiently precise to yield a substantially pure linear paraffin product. Instead, the separated kerosene range linear paraffin product may contain the contaminants described above in amounts sufficient to preclude use of the product for the special applications referred to earlier.

The principle prior art methods for upgrading kerosene range linear paraffins to substantially pure linear paraffins are mild hydrofining followed by acid treating, and severe hydrofining. While acid treating does remove aromatics from kerosene range linear paraffins, this is not an entirely satisfactory procedure. Acid treating addresses only the aromatics component of a contaminated paraffin stream, without improving product purity with respect to heteroatom compounds. In addition, acid treating raises significant concerns relating to health, safety, industrial hygiene, and environmental quality. Moreover, acid treating can actually increase the levels of sulfur in the final product.

As a general matter, processes are known whereby specific hydrocarbon fractions may be purified and/or isolated from a relatively crude source using solid adsorbents. In these prior art processes a bed of a solid adsorbent material is contacted with a hydrocarbon stream in either liquid or vapor phase under conditions favorable to adsorption. During this contacting stage a minor portion of the hydrocarbon stream is adsorbed into pores in the solid adsorbent, while the major portion, which may be termed the effluent or raffinate, passes through.

Depending on the process and the product involved, the adsorbent may be used either to adsorb the desired product, which is then desorbed and recovered, or to adsorb the undesired contaminants, resulting in an effluent which is the purified product.

In either event, during the contacting stage the solid adsorbent gradually becomes saturated with adsorbed material, which consequently must be periodically desorbed. If the adsorbent contains the undesired contaminants, desorption is necessary in order to free the adsorbent for further removal of contaminants. If the adsorbent contains the desired product, desorption both frees the adsorbent for further separation of the desired product from the hydrocarbon stream, and liberates the desired product from the adsorbent for recovery and, if desired, for further processing.

Desorption is generally accomplished by first isolating the bed of adsorbent material from the hydrocarbon stream, and then contacting the adsorbent bed with a stream of a substance which has the effect of displacing the adsorbed material from the solid adsorbent. This substance is referred to as desorbent. Once desorption is completed, the bed of solid adsorbent can again be brought into contact with the hydrocarbon stream.

The efficiency of the adsorption/desorption process is determined by several critical factors, including the precise adsorbent selected; temperature; pressure; flow rate of the hydrocarbon stream; concentrations of feed stream components; and, the desorbent.

Selection of a suitable desorbent for a given process is critical. The desorbent must efficiently displace the adsorbed material, without impairing the ability of the adsorbent to further adsorb that material when the adsorbent bed is again contacted with the hydrocarbon stream. For reasons of economy the desorbent should ideally be readily separable from the desorbed material, so that the desorbent can be recycled. Moreover, in processes where the effluent contains the purified product, there will inevitably be some contamination of the purified product with the desorbent when a bed of solid adsorbent which has been subjected to desorption is again contacted with the hydrocarbon stream, because the consequent adsorption of contaminants by the solid adsorbent will displace desorbent. The initial effluent will accordingly contain a high concentration of the desorbent, which will drop rapidly but remain measurable throughout the adsorption cycle. In these processes, then, it is additionally important for the desorbent to be easily separable from the purified product.

Overall, then, the desorbent should combine the following qualities: first, it should be inexpensive; second, it should efficiently displace the adsorbed material from the adsorbent; third, after displacing the adsorbed material from the adsorbent it should leave the adsorbent ready to efficiently adsorb additional material; fourth, it should itself be readily displaceable from the solid adsorbent by the material whose adsorption is desired; fifth, it should be readily separable from the adsorbed material in order to enable recovery and recycle of the desorbent; and sixth, in processes where the purified product is contained in the effluent the desorbent should be readily separable from the effluent in order to avoid contamination of the product.

The quantity of prior art in this area demonstrates the complexity, and the high degree of specificity, involved in matching a given feedstock, from which a given product is desired, with a suitable adsorbent/desorbent combination, under appropriate conditions to arrive at a commercially acceptable process.

FLECK et al., U.S. Pat. No. 2,881,862, discloses separating aromatic compounds and sulfur compounds from complex hydrocarbon streams through adsorption onto a "zeolitic metallo alumino silicate," which may be desorbed with linear pentane (see column 5, lines 49–54; column 6, lines 8–12).

KIMBERLIN et al., U.S. Pat. No. 2,950,336, discloses the separation of aromatic compounds and olefins from hydrocarbon mixtures that may also include paraffins, using a zeolitic molecular sieve which may be desorbed by gas purge, evacuation, displacement with an aromatic hydrocarbon, or steaming followed by dehydration (see column 4, lines 38–48).

TUTTLE et al., U.S. Pat. No. 2,978,407, discloses the separation of aromatic hydrocarbons from mixtures which include linear paraffins, isoparaffins, cyclic hydrocarbons, and aromatics, using molecular sieves having pore diameters of 13 Angstroms, which may be desorbed by gas purge and/or evacuation (see column 2, lines 65–70).

EPPERLY et al., U.S. Pat. No. 3,063,934, discloses removing aromatic compounds, olefins, and sulfur from the feed to a naphtha isomerization reactor using a molecular sieve, such as a Linde 10X or a Linde 13X molecular sieve, which may then be desorbed using the effluent from the isomerization reactor (see column 2, lines 36–41).

EPPERLY et al., U.S. Pat. Nos. 3,228,995 and 3,278,422 both generally disclose the separation of aromatics and/or nonhydrocarbons from saturated hydrocarbons and/or olefins using a zeolite adsorbent. The zeolite is desorbed with a polar or polarizeable substance, which is preferably ammonia, although sulfur dioxide, carbon dioxide, alcohols, glycols, halogenated compounds, and nitrated compounds may be used.

KONDO et al., U.S. Pat. No. 4,313,014, discloses the adsorptive separation of cyclohexene from a cyclohexene/cyclohexane mixture using a type X and/or type Y aluminosilicate zeolite, which may be desorbed with a trimethylbenzene (see column 2, lines 3–11).

OWAYSI et al., U.S. Pat. No. 4,567,315, discloses a process for removing aromatic hydrocarbons from a liquid paraffin. The aromatics are first adsorbed by a type X zeolite molecular sieve material, and are then desorbed using a polar or polarizeable substance such as an alcohol glycol (see column 3, lines 65–68 and column 7, lines 15–20). In a third step the desorbed aromatic hydrocarbons are washed from the zeolite bed using a solvent such as n-hexane, n-heptane, or iso-octane (see column 7, lines 26–30).

MIWA et al., U.S. Pat. No. 4,571,441, discloses separating a substituted benzene from a substituted benzene isomer mixture using a faujasite-type zeolitic adsorbent such as type X zeolite or type Y zeolite. Depending on the nature of the substituted benzene whose recovery is desired, the desorbent used may be toluene, xylene, dichlorotoluene, chloroxylene, or trimethylbenzene; an oxygen-containing substance such as an alcohol or a ketone; or, diethylbenzene (see column 3, lines 35–59).

Russian Patent 1298202 discloses a method for removing aromatics from a paraffin feedstock using a solid adsorbent such as silica gel, amorphous aluminosilicate, or faujasite-type zeolite. A bed of the solid adsorbent is first pretreated with a stream of purified paraffins obtained from a prior purification cycle. The paraffin feedstock is then passed through the bed of solid adsorbent to remove aromatics therefrom until the aromatic content of the effluent reaches a specified level. Desorption of the adsorbed aromatics is carried out at 50°–500° C. using steam, ammonia, isopropyl alcohol, acetone, toluene, or the like. The desorbent must then be removed from the solid absorbent using a gas purge at 200°–500° C., and the bed must consequently be cooled to between 20°–150° C., using either a stream of purified paraffins or a gas, before resuming the adsorption phase.

SUMMARY OF THE INVENTION

A process has now been discovered that may be used to efficiently and economically produce a linear paraffin product of exceptional purity, without resorting to acid treating or final stage hydrofining. An outstanding advantage of this process is that it can be integrated into a comprehensive hydrocarbon separation, purification, and isolation process, resulting in exceptional economy and efficiency of operation.

The present invention relates to a process for purifying a hydrocarbon feedstock which contains linear paraffins and at least one contaminant selected from the group consisting of aromatic compounds, nitrogen-containing compounds, sulfur-containing compounds, oxygen-containing compounds, color bodies, and mixtures thereof. The process comprises the steps of:

a) contacting a liquid feed stream of the hydrocarbon feedstock with an adsorbent comprising a zeolite having an average pore size of from about 6 to about 15 Angstroms under conditions suitable for the adsorption of at least one contaminant by the zeolite to produce a contaminant-loaded zeolite; and b) desorbing the contaminant-loaded zeolite using a desorbent comprising an alkyl-substituted benzene.

The zeolite may have a pore size of between about 6.8 and about 10 Angstroms, and may be substantially in the form of crushed or beaded particles.

In one particular embodiment, the zeolite may be a type Y zeolite, and more specifically may be a cation-exchanged type Y zeolite. The cations may be selected from the group consisting of alkali and alkaline earth metals.

In a particularly preferred embodiment, the cation-exchanged type Y zeolite is MgY zeolite.

The zeolite may alternatively be a type X zeolite, such as NaX zeolite.

In the process according to the present invention, the liquid feed stream may be contacted with the zeolite at a weight hourly space velocity of from about 0.2 to about 2.5, with a weight hourly space velocity of from about 0.75 to about 2.0 being preferred.

Similarly, the contaminant-loaded zeolite may be contacted with the desorbent at a weight hourly space velocity for the desorbent of from about 0.1 to about 2.5, with a a weight hourly space velocity of from about 0.3 to about 1.5 being preferred.

The operating temperature used for conducting the process according to the present invention may range from about 20° to about 250° C., with a range of from about 100° to about 150° C. being preferred.

While it is to be understood that the process according to the present invention is suitable for practice on a variety of feedstocks, which will contain an extremely varied and diverse assortment of contaminants, typically aromatic compounds are present in the feed stream at a concentration of from about 0.1 to about 10.0 wt %, and more typically at a concentration of from about 0.5 to about 3.0 wt %. These aromatic compounds may comprise, for example, alkyl-substituted benzenes, indanes, alkyl-substituted indanes, naphthalenes, tetralins, alkyl-substituted tetralins, biphenyls, acenaphthenes, and mixtures thereof.

The feed stream may contain nitrogen-containing compounds at a concentration of up to about 500 wppm, and more typically the concentration of the nitrogen-containing compounds is from about 1.0 to about 200 wppm. Typical nitrogen-containing compounds include indoles, quinolines, pyridines, and mixtures thereof.

Sulfur-containing compounds may be present in the feed stream at a concentration of up to about 100 wppm, with a concentration of from about 1.0 to about 15 wppm being more typical. These sulfur-containing compounds may include, for example, sulfides, thiophenes, mercaptans, and mixtures thereof.

In addition, color bodies may be present in the feed stream in an amount sufficient to produce a Pt/Co value of up to about 30 as measured by ASTM D-1209, although more typically the Pt/Co value will be between about 5 and 20.

Moreover, the feed stream may include heteroatom-containing compounds such as phenolics, which may be present in the feed stream at a concentration of up to about 600 wppm, and more usually at a concentration of between about 10 and 150 wppm.

In a preferred embodiment of the process according to the present invention, the desorbent comprises toluene, and most preferably is at least about 95% toluene. The desorbent may include dissolved water in amounts of up to about 500 wppm, and more particularly of from about 50 to about 300 wppm.

In the process according to the present invention the desorbent is preferably separated from the at least one contaminant after the desorbing step, and the desorbent is recycled to the desorbing step. The desorbent may be separated from the at least one contaminant by any conventional means, such as by distillation.

The adsorbent used in the process according to the present invention may include an inorganic binder such as silica, alumina, silica-alumina, kaolin, or attapulgite.

The present invention extends to the purified linear paraffin product produced according to the process according to the present invention. This purified linear paraffin product may have a purity of at least about 98.5 wt %, and may contain not greater than about 100 wppm aromatics, not greater than about 1 wppm nitrogen-containing compounds, not greater than about 0.1 wppm sulfur-containing compounds, and not greater than about 10 wppm oxygen-containing compounds. The amount of aromatic compounds present in the purified linear paraffin product may be not greater than about 10 wppm aromatics, and the purity of the purified linear paraffin product may be least about 99.7 wt %.

The amount of aromatics present in the purified linear paraffin product may be not greater than about 10 wppm aromatics.

Finally, the present invention includes a purified linear paraffin having a purity of at least about 98.5 wt %, which may contain not greater than about 100 wppm aromatics, not greater than about 1 wppm nitrogen-containing compounds, not greater than about 0.1 wppm sulfur-containing compounds, and not greater than about 10 wppm oxygen-containing compounds. The amount of aromatic compounds present in the purified linear paraffin may be not greater than about 10 wppm aromatics, and the purity of the purified linear paraffin may be least about 99.7 wt %.

The amount of aromatics present in the purified linear paraffin may be not greater than about 10 wppm aromatics.

DESCRIPTION OF PREFERRED EMBODIMENTS

The linear paraffin purification process according to the present invention has several major distinguishing features which impart the process with substantial advantages over the prior art.

First, the adsorption and desorption steps may be conducted entirely in the liquid phase, at substantially constant temperatures. This eliminates the time and expense, including increased equipment stress, involved in changing over between liquid and vapor phases as in the prior art.

Second, the process according to the present invention uses a nonpolar desorbent which is widely available, inexpensive, and easy both to displace from the solid adsorbent and to separate from the product. Use of a nonpolar desorbent additionally eliminates the need to wash, purge, or otherwise treat the solid adsorbent bed after the desorption step but before again contacting the solid adsorbent bed with the hydrocarbon feed stream.

Third, in the process according to the present invention the adsorption and desorption steps are conducted countercurrent. Use of the countercurrent technique results in a more efficient use of the desorbent, and consequently also leads to improved adsorption.

Fourth, according to the present invention, it has been determined that initial advantages can be realized by employing the countercurrent technique to conduct the adsorption step in a downflow fashion. This eliminates the detrimental density gradient-related backmixing which can occur during upflow adsorption as the relatively dense toluene is displaced from the solid absorbent by the relatively light paraffin feed stream. Moreover, by using a lower mass velocity while conducting desorption countercurrently in an upflow fashion, bed lifting concerns can be substantially reduced.

Fifth, it has been discovered that the efficiency in economy of the process according to the present invention can be significantly enhanced by the use of recycle techniques for the recovery and recycle of hydrocarbon feed and desorbent remaining in the adsorber at the end of their respective adsorb and desorb cycles.

Sixth, the process according to the present invention uses an unusual, highly-sophisticated analytical technique to monitor the composition of the hydrocarbon feed stream. This technique, known as Supercritical Fluid Chromatography "SFC", provides an exceptionally accurate method for determining the proper cycle time between adsorption and desorption, by providing better detection of aromatics concentration than conventional technology.

Seventh, in the process according to the present invention a nitrogen blanket is used to conduct the entire process under oxygen-free conditions. This avoids introduction of oxygen into the hydrocarbon and desorbent streams, which could otherwise lead to oxidative degradation of the feed hydrocarbon components and consequent formation of undesirable side products.

The overall effect of these advantages may be appreciated by reference to the fact that the process according to the present invention makes it possible to recover at least about 95 percent of the linear paraffins present in the initial hydrocarbon charge introduced into the solid adsorbent bed in a single adsorb/desorb cycle, without heating, cooling, washing, purging, or changing between vapor and liquid phases. This measurement of efficiency is referred to hereinafter as "once-through paraffin recovery."

The feedstock used to form the hydrocarbon stream to be purified according to the process of the present invention may be any hydrocarbon fraction which includes linear paraffins contaminated with aromatic and/or heteroatom compounds. Typically, the paraffins present in the feed stream have a carbon chain length of $C_8$–$C_{22}$.

One feedstock suitable for use in the process according to the present invention is the linear paraffin product from a process for separating linear paraffins from a kerosene-range hydrocarbon fraction. The linear paraffin effluent from such a process will typically consist principally of linear paraffins which, due to the nature of the crude stock from which they were isolated, will be contaminated with aromatics as well as with heteroatom compounds.

It will be understood by those of ordinary skill in the art that feedstocks which may be treated by the process according to the present invention will contain an extremely diverse array of contaminants, composed principally of aromatics and oxygen-, sulfur-, and nitrogen-containing compounds as well as color bodies. Therefore, while representative categories of these contaminants are described below, the specific enumeration of these categories herein is illustrative only, and should not be considered as either limiting or exhaustive.

The aromatics may be present in the hydrocarbon stream in an amount of from about 0.1 to about 10.0 weight percent, and are typically present in an amount of from about 0.5 to about 3.0 percent.

Typical aromatic compounds present in the feedstock include monocyclic aromatics, such as alkyl-substituted benzenes, tetralins, alkyl-substituted tetralins, indanes, and alkyl-substituted indanes; and bicyclic aromatics, such as naphthalenes, biphenyls, and acenaphthenes.

The feedstock may contain oxygen-containing compounds. The most common oxygen-containing compounds found in the feedstock are phenolics, which may be present in the hydrocarbon feedstock at a concentration of up to about 600 wppm. More typically, phenolics are present in the feedstock at a concentration of between about 10 and 150 wppm.

The amount of sulfur-containing compounds in the hydrocarbon feedstock may be as high as about 100 wppm. Typically the sulfur content is between about 1 and 15 wppm. Typical sulfur-containing compounds present in the feedstock include sulfides, thiophenes, and mercaptans. Mercaptans may be present in amounts of up to about 1 wppm.

Nitrogen-containing compounds may be present in the hydrocarbon feedstock at a concentration of up to about 500 wppm. More typically, the concentration of nitrogen-containing compounds is between about 1.0 and 200 wppm. Typical nitrogen-containing compounds present in the feedstock include indoles, quinolines, and pyridines.

In addition to the above contaminants, the feedstock to be purified according to the present invention may include color bodies. The Pt/Co color of the feedstock may be as high as about 30, measured by ASTM D-1209, and is typically between about 5 and 20.

The hydrocarbon feed stream is preferably contacted with a solid adsorbent in a liquid phase. Before being contacted with the absorbent the feed is heated to a temperature of from about 20° to about 250° C.; the preferred temperature range for carrying out absorption is from about 100° to about 150° C. Back pressure regulation can be used to ensure maintenance of the liquid phase.

The flow rate of the hydrocarbon feed stream through the solid adsorbent is adjusted to range from about 0.2 to about 2.5 WHSV, with the preferred range being from about 0.75 to about 2.0 WHSV.

The desorbent is likewise contacted with the solid adsorbent in the liquid phase. The desorbent may also be heated to a temperature from about 20° to about 250° C. before being contacted with the adsorbent, with the preferred temperature range being substantially the same as the temperature at which the feed stream is contacted with the adsorbent.

The flow rate of the desorbent through the solid adsorbent may vary at least from about 0.1 to about 2.5 WHSV, and is preferably from about 0.3 to about 1.5 WHSV.

The solid adsorbent used in the process according to the present invention may be any molecular sieve. It is preferred to use zeolites of the of the faujasite family, which includes natural and synthetic zeolites having an average having an average pore diameter of from about 6 to about 15 Angstroms. Representative examples of molecular sieves include faujasites, mordenites, and zeolite types X, Y, and A. The zeolites most preferred for use in the process according to the present invention are zeolite types X and Y.

The zeolites may be subjected to cation exchange prior to use. Cations which may be incorporated into the zeolites, through ion-exchange processes or otherwise, include all alkali and alkaline earth metals, as well as trivalent cations, with Na, Li, and Mg being preferred.

The preferred zeolites for use in the process according to the present invention are NaX zeolite, commonly referred to as 13X zeolite, and MgY zeolite.

While the zeolite may be used in any form, it is preferred to use zeolite in the form of beaded or crushed particles, rather than extruded particles. The zeolite may be used neat, or in association with known binders including, but not limited to, silica, alumina, aluminosilicates, or clays such as kaolin and attapulgite.

In a preferred embodiment of the process according to the present invention the adsorption and desorption phases are conducted counter-current to each other. Specifically, adsorption is effected by contacting the hydrocarbon feedstock with the bed of solid adsorbent in downflow fashion.

This procedure, which is unique for most fixed bed processes, has two principal advantages. First, downflow adsorption eliminates density gradient backmixing, which interferes with the adsorption process and thus impairs product quality. Second, conducting desorption in an upflow direction using a lower mass velocity reduces concerns over lifting of the beds of solid adsorbent, which can otherwise occur during desorption.

The prior art desorption processes are also typified by the use of polar or polarizeable substances as desorbents. In contrast, in its preferred embodiment the process according to the present invention utilizes a nonpolar, alkyl-substituted benzene to desorb the contaminants from the saturated adsorbent. The ability to use a nonpolar desorbent represents a considerable advance over the prior art, such as OWAYSI et al., because it eliminates the need to wash the bed of solid adsorbent after desorption and before resuming adsorption. This confers substantial advantages in design, operation, efficiency, and economy.

Under the operating conditions which have been found most suitable for carrying out the process according to the present invention, it has unexpectedly been discovered that the desorbent ma be toluene.

Thus, the process according to the present invention enables use of a desorbent, mainly toluene, which is efficient, readily available, inexpensive, easily displaced from the solid adsorbent during the subsequent adsorption step, and simply separated from the product.

While the aromatic desorbent may be used in a mixture with other hydrocarbon having similar boiling points (e.g., heptane may be used with toluene), it is preferred to formulate the desorbent principally from the aromatic substituent, with toluene being the preferred aromatic. Thus, while the desorbent may include non-toluene hydrocarbons in an amount of up to about 90%, the preferred desorbent contains non-toluene hydrocarbons in an amount of between about 0.0001 and 10%. In a particularly preferred embodiment the desorbent comprises at least about 95 percent by weight toluene, with the balance of the desorbent being made up of non-toluene hydrocarbons.

The desorbent may also include dissolved moisture in relative trace amounts. Generally, dissolved water may be present in the desorbent in an amount of up to about 500 wppm, with a range of from about 50 to about 300 wppm being preferred.

Because the desorbent displaces the contaminants by taking their place in the pores of the solid adsorbent, when the regenerated adsorbent bed is placed back on line and is again contacted with the hydrocarbon feedstock, the initial effluent issuing from the adsorbent bed will contain some of the desorbent. This may be separated from the purified linear paraffin product by any conventional means, such as by distillation. The desorbent thus separated may, if desired, be recycled to the desorption stage; water may be added to or removed from the separated desorbent to achieve the desired composition for the desorbent prior to recycle.

By means of this process a linear paraffin product may be obtained in which the concentration of aromatic compounds has been reduced from a feedstock content of as high as about 10 percent to a product content of less than about 100 wppm, and even of less than about 50 wppm.

Comparable degrees of purification may be obtained with respect to sulfur- and nitrogen-containing contaminants. Whereas the hydrocarbon feedstock may include up to about 100 wppm of sulfur and up to about 500 wppm of nitrogen-containing hydrocarbons, the purified product will contain less than 0.1 wppm of sulfur-containing compounds; less than 1 wppm of nitrogen-containing compounds; and, less than about 10 wppm of phenolics. The advantages which can be realized through the practice of the process according to the present invention are perhaps most simply stated, and most dramatically evident, in the fact that 95% of the linear paraffins present in the initial feedstock charged to the solid adsorbent bed are recovered in a single adsorb/desorb cycle. This recovery is accomplished without resort to washing, purging, heating, cooling, liquid/vapor phase changes, or other complications.

The process according to the present invention may be more fully appreciated through an understanding of how it fits into an overall hydrocarbon processing and refining operation:

In an initial step a full-range kerosene hydrocarbon feed stream is processed through a linear paraffins separation process. This feed stream typically contains only a minor proportion of linear paraffins, 8–30%, with the balance of the stream being made up of iso- and cycloparaffins, aromatics, and heteroatom-containing compounds.

The partially purified linear paraffin product, which is contaminated by aromatic compounds and by heteroatom-containing compounds but which contains essentially no olefins, then becomes the feed stream for the process according to the present invention. The concentration of aromatics in the feed stream, which affects adsorption cycle length, can be measured using the Supercritical Fluid Chromatography (SFC) process referred to earlier. This technique is considerably more accurate than using ultraviolet spectrophotometric techniques. This increased accuracy has the pronounced benefit of enabling precise tailoring of the process conditions, and principally of the adsorb-/desorb cycle time, to effectively calibrate the process to correspond to the degree of contamination in the feed stream, maximizing the efficiency of the overall process.

The process according to the present invention comprises two fixed beds of solid adsorbent being operated in cyclic fashion, so that one bed is undergoing adsorption while the other bed is being desorbed. Before the process is initiated the beds are preferably blanketed with nitrogen to create an oxygen-free environment. This prevents oxygen from being introduced into the hydrocarbon stream; otherwise, oxidative degradation of the feed hydrocarbon components could occur, resulting in formation of undesirable side products.

When the bed undergoing adsorption reaches the end of its cycle, as measured by a threshold value for aromatics concentration in the adsorption effluent, the beds are switched. The switching may be accomplished using a programmable controller and remote-operated valves. A typical adsorption cycle will last from about 4 hours to about 17 hours, but can vary considerably depending on variables such as feed rate, the concentration of aromatics in the feed, the age of the solid adsorbent, and the amount of absorbent used.

The purified linear paraffin effluent from the adsorption step is sent on to a fractionation column, where light paraffins and residual toluene are removed.

During fractionation the residual desorbent present in the purified paraffin effluent is removed as a liquid distillate. A mixture of light paraffins and toluene is taken off the column as a liquid sidestream, while the heavier paraffin bottoms product is sent on for separation into final products.

The contaminated toluene effluent from the desorption step is sent to a toluene recovery tower. Overhead toluene product from this tower may be heated and recycled to the solid adsorbent beds for use in the desorption step. The tower bottoms product may be cooled, and recycled to a linear paraffins separation process.

Prior to entering the recovery tower the contaminated toluene may be sent to a storage tank, which can also receive recycled toluene from the fractionation column overhead, and makeup toluene may be used to replace the toluene which escapes recovery and recycle. This storage tank can be used to mix the various streams sent into it in order to provide an output stream of consistent composition.

In summary, then, the toluene used for desorption of the solid adsorbent beds is recycled. However, because light paraffins in the $C_6$–$C_8$ range are very difficult to separate from toluene by fractionation, these paraffins will tend to build up in the recycled desorbent. This build-up can be controlled by removing a purged stream from the desorbent recycle, thereby limiting the presence of light hydrocarbon component impurities in the desorbent to about 5%.

Because the bed of solid adsorbent is full of feed stream at the end of an adsorption step, the initial effluent from the subsequent desorption step will consist largely of residual paraffins. A particularly valuable feature of the process according to the present invention is recovery of these paraffins by providing for a recycle of the initial desorbent effluent back to the feed for the present process. When desorbent begins to appear in the effluent, the effluent can then be sent to the toluene recovery tower. By this procedure many of the paraffins that would otherwise be rejected as toluene recovery tower bottoms can be recovered, resulting in an improved once-through paraffin recovery.

The initial desorb cycle effluent that is recycled may include toluene in trace quantities, resulting in a concentration of toluene in the feed stream of up to about 0.22%, with a concentration range of from about 0.0001 to about 0.15% being preferred. At these levels the toluene behaves simply as another aromatic contaminant in the feed stream.

Similarly, because the bed of solid adsorbent is full of toluene at the end of a desorption step, the initial effluent from the subsequent adsorb cycle will consist largely of residual toluene. Therefore, in the process according to the present invention this initial adsorption effluent is routed to the toluene recovery tower, enabling the toluene therein to be recovered and recycled. When the paraffin content of the adsorption effluent begins to rise the effluent stream is routed to the holding tank, and from there is sent to the fractionation column. This has the particularly valuable effect of reducing the fractionation load to this tower.

The process according to the present invention may be further appreciated by reference to the following examples and table, which are of course only representative of the present invention and in no way limiting.

EXAMPLE I

A tubular reactor 2.65" in diameter and 8' in length loaded with 5500 g of NaX 13X) zeolite was operated at 250° F. (approximately 121° C.) and 110 psig on the feed described in Table 1 for 2500 hours. Adsorb operations were conducted at 1.0 WHSV and desorb operations were conducted at 0.5 WHSV. Product material showed less than 100 wppm aromatics throughout the 2500 hour run, with cycle lengths of 12 hours.

Every 12 hours the adsorb bed Was switched directly to desorb service, and the desorb bed was switched directly to adsorb service. Reactor product after fractionation to remove toluene desorbent showed the composition ranges in Table 1.

TABLE 1

| | Feed and Product Composition | |
|---|---|---|
| | Feed | Product |
| n-Paraffin Range | $C_8$–$C_{22}$ | $C_8$–$C_{22}$ |
| n-Paraffin Purity | 97–99 wt % | 98.5–99.7 wt % |
| Aromatics | 0.6–2.4 wt % | <10–80 wppm |
| Nitrogen | 100–200 wppm | <1 wppm |
| Sulfur | 0.1–12 wppm | <0.1 wppm |
| Phenolics | 10–150 wppm | <10 wppm |
| Color bodies | 5–10 | 5 |

EXAMPLE II

The reactor described in Example I was operated under conditions similar to those of Example I, with recycle streams employed to increase efficiency. Desorb cycle effluent from the first 30 minutes of each 12 hour desorb cycle was routed directly back to the feed container. This recycle stream introduced levels of toluene into the feed container at levels of up to 760 wppm. The toluene presence showed no effect on reactor product purity, and increased once-through paraffin recovery to greater than 95%.

The desorb cycle effluent from the balance of the 12 hour desorb cycle was collected and continuously fractionated to generate recycle toluene. Recycling this fractionated stream back to the desorbent container increased the non-toluene hydrocarbon component in the desorbent to a level of 0.6 wt %. This recycle stream reduced the makeup desorbent requirements, while showing no impact on reactor product purity and without affecting the rate of sieve deactivation. The reactor effluent remaining after fractionation to remove desorbent was similar in composition to that of Example I, as described in Table 1.

It will be appreciated to those of ordinary skill in the art that, while the present invention has been described herein by reference to particular means, methods, and materials, the scope of the present invention is not limited thereby, and extends to any and all other means, methods, and materials suitable for practice of the present invention.

What we claim is:

1. A process for purifying a hydrocarbon feedstock which contains at least one contaminant comprising aromatic compounds, said process comprising the consecutive steps of:

(a) contacting a liquid feed stream of said hydrocarbon feedstock with an adsorbent comprising a zeolite under conditions suitable for the adsorption of said aromatic compounds by said zeolite to produce an aromatic compound-loaded zeolite; and (b) desorbing said aromatic compound-loaded zeolite using a desorbent comprising at least about 95% toluene.

2. The process as defined by claim 1, further comprising con acting said liquid feed stream with said zeolite at a weight hourly space velocity of from about 0.2 to about 2.5.

3. The process as defined by claim 2, wherein said weight hourly space velocity is from about 0.75 to about 2.0.

4. The process as defined by claim 1, further comprising contacting said contaminant-loaded zeolite with said desorbent at a weight hourly space velocity for said desorbent of from about 0.1 to about 2.5.

5. The process as defined by claim 4, wherein said weight hourly space velocity for said desorbent is from about 0.3 to about 1.5.

6. The process as defined by claim 1, further comprising contacting at an operating temperature of from about 20° to about 250° C.

7. The process as defined by claim 6, wherein said operating temperature is from about 100° to about 150° C.

8. The process as defined by claim 1, wherein said aromatic compounds are present in said feed stream at a concentration of from about 0.1 to about 10.0 wt %.

9. The process as defined by claim 8, wherein the concentration of said aromatic compounds is from about 0.5 to about 3.0 wt %.

10. The process as defined by claim 8, wherein said aromatic compounds are selected from the group consisting of alkyl-substituted benzenes, indanes, alkyl-substituted indanes, naphthalenes, tetralins, alkyl-substituted tetralins, biphenyls, acenaphthenes, and mixtures thereof.

11. The process as defined by claim 1, wherein said desorbent further comprises dissolved water.

12. The process as defined by claims 1, wherein said desorbent comprises dissolved water.

13. The process as defined by claim 12, wherein the amount of dissolved water present in said toluene is from about 50 to about 300 wppm.

14. The process as defined by claim 1, further comprising separating said desorbent from said aromatic compounds after said desorbing step, and recycling said desorbent to said desorbing step.

15. The process as defined by claim 14, wherein said desorbent is separated from said aromatic compounds by distillation.

16. The process as defined by claim 1, wherein said adsorbent further comprises an inorganic binder selected from the group consisting of silica, alumina, silica-alumina, kaolin, and attapulgite.

17. A purified linear paraffin product produced according to the process as defined by claim 1, having a purity of at least about 98.5 wt %.

18. The purified linear paraffin product as defined by claim 17, comprising not greater than about 80 wppm aromatics.

19. The purified linear paraffin product as defined by claim 18, comprising not greater than about 10 wppm aromatics.

20. The purified linear paraffin product as defined by claim 17, having a purity of at least about 99.7wt %.

21. The process as defined by claim 1, wherein said hydrocarbon feedstock comprises linear paraffins.

22. The process as defined by claim 21, wherein said process further comprises separating said linear paraffins from a kerosene-range hydrocarbon fraction.

23. The process as defined by claim 1, wherein said zeolite has an average pore size within the range of about 6 to about 15 Angstroms.

24. The process as defined by claim 23, wherein said pore size is between about 6.8 and about 10 Angstroms.

25. The process as defined by claim 24, wherein said zeolite is substantially in the form of crushed particles.

26. The process as defined by claim 24, wherein said zeolite is substantially in the form of beaded particles.

27. The process as defined by claim 24, wherein said zeolite is a type Y zeolite.

28. The process as defined by claim 27, wherein said type Y zeolite is a cation-exchanged type Y zeolite.

29. The process as defined by claim 28, wherein said cation-exchanged type Y zeolite comprises cations selected from the group consisting of alkali and alkaline earth metals.

30. The process as defined by claim 29, wherein said cation-exchanged type Y zeolite is MgY zeolite.

31. The process as defined by claim 24, wherein said zeolite is a type X zeolite.

32. The process as defined by claim 31, wherein said type X zeolite is NaX zeolite.

33. The process as defined by claim 31, wherein said type X zeolite is a cation-exchanged type X zeolite.

34. The process as defined by claim 33, wherein said cation-exchanged type X zeolite comprises cations selected from the group consisting of alkali and alkaline earth metals.

35. The process as defined by claim 1, wherein said desorbent comprises dissolved water.

36. The process as defined by claim 35, wherein the amount of dissolved water present in said toluene is up to about 500 wppm.

37. The process as defined by claim 36, wherein the amount of dissolved water present in said toluene is from about 50 to about 300 wppm.

38. A process for purifying hydrocarbon feedstocks comprising linear paraffins and at least one contaminant comprising aromatic compounds, said process comprising the steps of:

a) contacting a liquid feed stream of said hydrocarbon feedstocks, at a weight hourly space velocity of from about 0.2 to about 2.5, with an adsorbent comprising a zeolite having an average pore size of from about 6 to about 15 Angstroms, at an operating temperature of from about 20° to about 250° C., to produce an aromatic compound-loaded zeolite;

b) desorbing said aromatic compound-loaded zeolite using a desorbent comprising at least about 90% toluene at a weight hourly space velocity of from about 0.1 to about 2.5 WHSV, to produce an effluent stream comprising said desorbent in admixture with said aromatic compound;

c) separating said desorbent from said aromatic compound; and d) recycling said desorbent for further use in desorbing said aromatic compound-loaded zeolite, wherein said aromatic compounds are present in said liquid feed stream at a concentration of from about 0.1 to about 10 wt %.

39. The process as defined by claim 38, wherein said weight hourly space velocity of said liquid feed stream is from about 0.75 to about 2.0 WHSV; said average pore size of said zeolite is between about 6.8 and about 10 angstroms; said operating temperature is from about 100° to about 150° C.; said desorbent comprises at least about 95% by weight toluene; said weight hourly space velocity of said desorbent is from about 0.3 to about 1.5 WHSV; and said aromatic compounds are present in said liquid feed stream at a concentration of from about 0.5 to about 3 wt %.

40. A purified linear paraffin product produced according to the process as defined by claim 38, having a purity of at least about 98.5 wt %.

41. The purified linear paraffin product as defined by claim 40, comprising not greater than about 80 wppm aromatics.

42. The purified linear paraffin product as defined by claim 41, comprising not greater than about 10 wppm aromatics.

43. The purified linear paraffin product as defined by claim 40, having a purity of at least about 99.7 wt %.

44. The purified linear paraffin product as defined by claim 43, comprising not greater than about 100 wppm aromatics, not greater than about 1 wppm nitrogen-containing compounds, not greater than about 0.1 wppm sulfur-containing compounds, and not greater than about 10 wppm oxygen-containing compounds.

45. The purified linear paraffin product as defined by claim 44, comprising not greater than about 10 wppm aromatics.

46. A wash-free process for purifying a hydrocarbon feedstock which contains at least one contaminant comprising aromatic compounds, said process comprising the steps of:

a) contacting a liquid feed stream of said hydrocarbon feedstock with an adsorbent under conditions suitable for the adsorption of said aromatic compounds by said adsorbent to produce an aromatic compound-loaded adsorbent;

b) desorbing said aromatic compound-loaded adsorbent using a non-polar desorbent comprising at least about 95% toluene; and c) resuming adsorption directly after desorbing in step b) without washing said adsorbent.

47. The purified linear paraffin product as defined by claim 46, comprising not greater than about 80 wppm aromatics, not greater than 1 wppm nitrogen-containing compounds, not greater than 0.1 wppm sulfur-containing compounds, and not greater than 10 wppm oxygen-containing compounds.

48. The purified linear paraffin product as defined by claim 47, comprising not greater than about 10 wppm aromatics.

49. The process as defined by claim 46, wherein said aromatic compounds are present in said feed stream at a concentration of from about 0.1 to about 10.0 wt %.

50. The process as defined by claim 49, wherein the concentration of said aromatic compounds is from about 0.5 to about 3.0 wt %.

51. The process as defined by claim 49, wherein said aromatic compounds are selected from the group consisting of alkyl-substituted benzenes, indanes, alkyl-substituted indanes, naphthalenes, tetralins, tetrahydronaphthane alkyl-substituted tetralins, biphenyls, acenaphthenes, and mixtures thereof.

52. The process as defined by claim 46, wherein said adsorbent is a zeolite having an average pore size of up to about 15 Angstroms.

53. The process as defined by claim 52, wherein said zeolite has an average pore size of from about 6 to about 15 Angstroms.

54. The process as defined by claim 53, wherein said pore size is between about 6.8 and about 10 Angstroms.

55. The process as defined by claim 54, wherein said zeolite is substantially in the form of crushed particles.

56. The process as defined by claim 54, wherein said zeolite is substantially in the form of beaded particles.

57. The process as defined by claim 54, wherein said zeolite is a type Y zeolite.

58. The process as defined by claim 57, wherein said type Y zeolite is a cation-exchanged type Y zeolite.

59. The process as defined by claim 58, wherein said cation-exchanged type Y zeolite comprises cations selected from the group consisting of alkali and alkaline earth metals.

60. The process as defined by claim 59, wherein said cation-exchanged type Y zeolite is MgY zeolite.

61. The process as defined by claim 54, wherein said zeolite is a type X zeolite.

62. The process as defined by claim 61, wherein said type X zeolite is NaX zeolite.

63. The process as defined by claim 53, wherein said adsorbent further comprises an inorganic binder selected from the group consisting of silica, alumina, silica-alumina, kaolin, and attapulgite clay.

64. The process as defined by claim 46, further comprising contacting said liquid feed stream with said adsorbent at a WHSV of from about 0.2 to about 2.5.

65. The process as defined by claim 64, wherein said weight hourly space velocity is from about 0.75 to about 2.0 WHSV.

66. The process as defined by claim 46, further comprising contacting said aromatic compound-loaded adsorbent with said desorbent at a weight hourly space velocity for said desorbent of from about 0.1 to about 2.5 WHSV.

67. The process as defined by claim 66, wherein said weight hourly space velocity for said desorbent is from about 0.3 to about 1.5 WHSV.

68. The process as defined by claim 46, further comprising contacting said liquid feedstream of said hydrocarbon feedstock with said adsorbent at an operating temperature of from about 20° C. to about 250° C.

69. The process as defined by claim 68, wherein said operating temperature is from about 100° C. to about 150° C.

70. The process as defined by claim 46, further comprising separating said desorbent from said aromatic compounds after said desorbing step, and recycling said desorbent to said desorbing step.

71. The process as defined by claim 70, wherein said desorbent is separated from said aromatic compounds by distillation.

72. A purified linear paraffin product produced according to the process as defined by claim 46, having a purity of at least about 98.5 wt %.

73. The purified linear paraffin product as defined by claim 72, comprising not greater than about 10 wppm aromatics.

74. The purified linear paraffin product as defined by claim 72, having a purity of at least about 99.7 wt %.

75. A process for purifying a hydrocarbon feedstock which contains at least one contaminant comprising aromatic compounds, said process comprising the steps of:

a) contacting a liquid feed stream of said hydrocarbon feedstock with an adsorbent under conditions suitable for the adsorption of said aromatic compounds by said adsorbent to produce an aromatic compound-loaded adsorbent; and b) desorbing said aromatic compound-loaded adsorbent using a non-polar desorbent, wherein step a) and step b) are conducted counter current to each other.

76. The process as defined by claim 75, wherein said step b) comprises flowing said desorbent at a predetermined mass velocity in an upflow fashion to desorb said aromatic compound-loaded adsorbent.

77. The process as defined by claim 76, wherein said predetermined mass velocity of said desorbent in step b) is lower than the mass velocity of said liquid feed in step a).

78. The process as defined by claim 77, wherein said desorbent is separated from said aromatic compounds.

79. The process as defined by claim 75, wherein said contacting of step a) comprises passing said liquid feed of said hydrocarbon feedstock in a downflow fashion to contact said adsorbent.

80. The process as defined by claim 79, further comprising separating said desorbent from said aromatic compounds after said desorbing step, and recycling said desorbent to said desorbing step.

81. The process as defined by claim 79, wherein said non-polar desorbent is an alkyl-substituted benzene.

82. The process as defined by claim 81, wherein said desorbent comprises toluene.

83. The process as defined by claim 82, wherein said desorbent comprises about 95% toluene.

84. The process as defined by claim 82, wherein said desorbent further comprises dissolved water.

85. The process as defined by claim 84, wherein the amount of dissolved water present in said toluene is up to about 500 wppm.

86. The process as defined by claim 85, wherein the amount of dissolved water present in said toluene is from about 50 to about 300 wppm.

87. The process as defined by claim 79, wherein said adsorbent is a zeolite having an average pore size of from about 15 Angstroms.

88. The process as defined by claim 87, wherein said zeolite has an average pore size of from about 6 to about 15 Angstroms.

89. The process as defined by claim 88, wherein said pore size is between about 6.8 and about 10 Angstroms.

90. A purified linear paraffin product produced according to the process as defined by claim 75, having a purity of at least about 98.5 wt %.

91. The purified linear paraffin product as defined by claim 90, comprising not greater than about 10 wppm aromatics.

92. The purified linear paraffin product as defined by claim 90, having a purity of at least about 99.7 wt %.

* * * * *